US005722187A

United States Patent [19]

Pamio et al.

[11] Patent Number: 5,722,187

[45] Date of Patent: Mar. 3, 1998

[54] SUPPORTING DEVICE PARTICULARLY FOR SPORTS SHOES

[75] Inventors: Cecilia Pamio; Massimo Foffano, both of Treviso; Bruno Borsoi, Vittorio Veneto, all of Italy

[73] Assignee: Nordica S.p.A., Trevignano, Italy

[21] Appl. No.: 588,177

[22] Filed: Jan. 18, 1996

[30] Foreign Application Priority Data

Jan. 31, 1995 [IT] Italy ..... TV95A0010

[51] Int. Cl.[6] ..... A43B 5/04

[52] U.S. Cl. ..... 36/88; 36/107; 36/109; 36/114; 36/115

[58] Field of Search ..... 36/88, 89, 105, 36/107, 109, 113, 114, 115, 116, 117.1

[56] References Cited

U.S. PATENT DOCUMENTS 3,545,107 12/1970 Cinquegrana et al. ..... 36/105

4,030,214 6/1977 Hanson et al. ..... 36/105

4,655,465 4/1987 Schaeffer ..... 36/115

FOREIGN PATENT DOCUMENTS 2606800 8/1977 Germany ..... 36/89

*Primary Examiner*—M. D. Patterson

*Attorney, Agent, or Firm*—Guido Modiano; Albert Josif

[57] ABSTRACT

A supporting device, particularly for sports shoes, which is constituted by a plurality of elements that are axially and elastically connected to each other. The elements are associated longitudinally with respect to the rear region of the shoe and have a curved shape at their mutual joining region. This device allows to control the articulation of the ankle, and particularly to control the longitudinal and lateral flexibility of the shoe.

12 Claims, 8 Drawing Sheets

SUPPORTING DEVICE PARTICULARLY FOR SPORTS SHOES

BACKGROUND OF THE INVENTION

The present invention relates to a supporting device, particularly for sports shoes.

The technical need to control flexibility in sports shoes, for example ski boots or snowboarding boots, is currently felt.

In the first case, control is performed only on longitudinal flexibility, since skiing requires the boot to be laterally rigid in order to allow optimum transmission of efforts for steering the ski.

In the second case, control is performed both on longitudinal flexibility and on lateral flexibility, since snowboarding requires the ankle joint to be free in all directions, in order to allow the shifts in the center of gravity of the athlete's body that are required to steer the board.

FR-1,126,589 discloses a ski boot in which at the rear region of the upper there is an opening that forms two flaps that can be mutually fastened by means of laces. Laterally to the upper there are adapted slightly tilted pockets inside which there are bars, whose purpose is to stiffen said upper, transmitting most of the reaction for ski tilting directly to the leg, limiting the component of the torsion stress that affects the ankle during this step of skiing.

This solution, however, does not allow control of the longitudinal articulation of the ankle, which is entirely entrusted to the flexing of the boot, whereas the lateral articulation of the ankle is inhibited by the presence of the stiffening bars.

FR-1,193,946 discloses a ski boot that comprises reinforcement elements that are arranged substantially at the lateral surface of the upper that affects the ankle region. Even this solution, however, is not optimum, since despite controlling the longitudinal articulation of the ankle and stiffening the upper laterally, said elements act directly on said upper, so as to produce localized pressure regions that can cause discomfort or damage to the ankle; the solution is also constructively complicated.

U.S. Pat. No. 3,747,235 discloses a device that allows to use a low shoe which, in combination with a lever affecting the rear region of the leg and associated therewith at the calf, allows to control the longitudinal flexing of the user's leg and to effectively transmit efforts to the ski, once the shoe has been associated with a ski.

This solution, too, has a drawback that is due to constructive complexity and to the fact that only the longitudinal articulation of the ankle is controlled, whereas lateral articulation is fully inhibited.

FR-2,358,119 discloses a ski boot that comprises a rear quarter that is divided transversely into three separate elements that can partially slide with respect to each other in a longitudinal direction.

This solution, too, does not fully solve the described technical problems; although it allows to facilitate forward flexing of the leg and allows limited control of backward flexing, since once said elements interact with each other by mutual abutment further backward flexing is contrasted exclusively by the deformability of said quarter, there is no possibility of allowing and controlling lateral articulation of the ankle.

Another solution is shown in U.S. Pat. No. 5,193,294 in the name of this same Assignee, which discloses a ski boot that comprises a quarter that is composed of two or more independent strap elements that are associated with each other and/or with a shell in an oscillating manner; there are also two lateral stiffening bars.

Even this solution, however, has drawbacks: despite allowing to control the longitudinal and lateral articulation of the ankle, it entails a considerable constructive complexity of its individual elements and of their assembly, and has accordingly high production costs.

SUMMARY OF THE INVENTION

The aim of the present invention is therefore to solve the described technical problems, eliminating the drawbacks of the mentioned prior art, by providing a device, particularly for sports shoes, that allows to perform active control of the articulation of the ankle both longitudinally and laterally.

Within the scope of this aim, an important object is to provide a device that allows, while walking in sports shoes, to avoid possible sprains and at the same time allows, during sports practice, to control the longitudinal and lateral flexibility of the shoe.

Another important object is to provide a device that is structurally simple and can be industrialized easily.

Another important object is to provide a device that is easily associable with the shoe.

Another object is to provide a device that associates with the preceding characteristics that of being reliable and safe in use and can be obtained with conventional and known machines and facilities.

This aim, these objects, and others which will become apparent hereinafter are achieved by a supporting device, particularly for sports shoes, characterized in that it comprises a plurality of elements axially and elastically connected to each other and longitudinally associated with the rear region of said shoe, said elements having, at their mutual joining region, a curved shape that is adapted to allow an abutment between them upon a lateral oscillation applied to said shoe.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
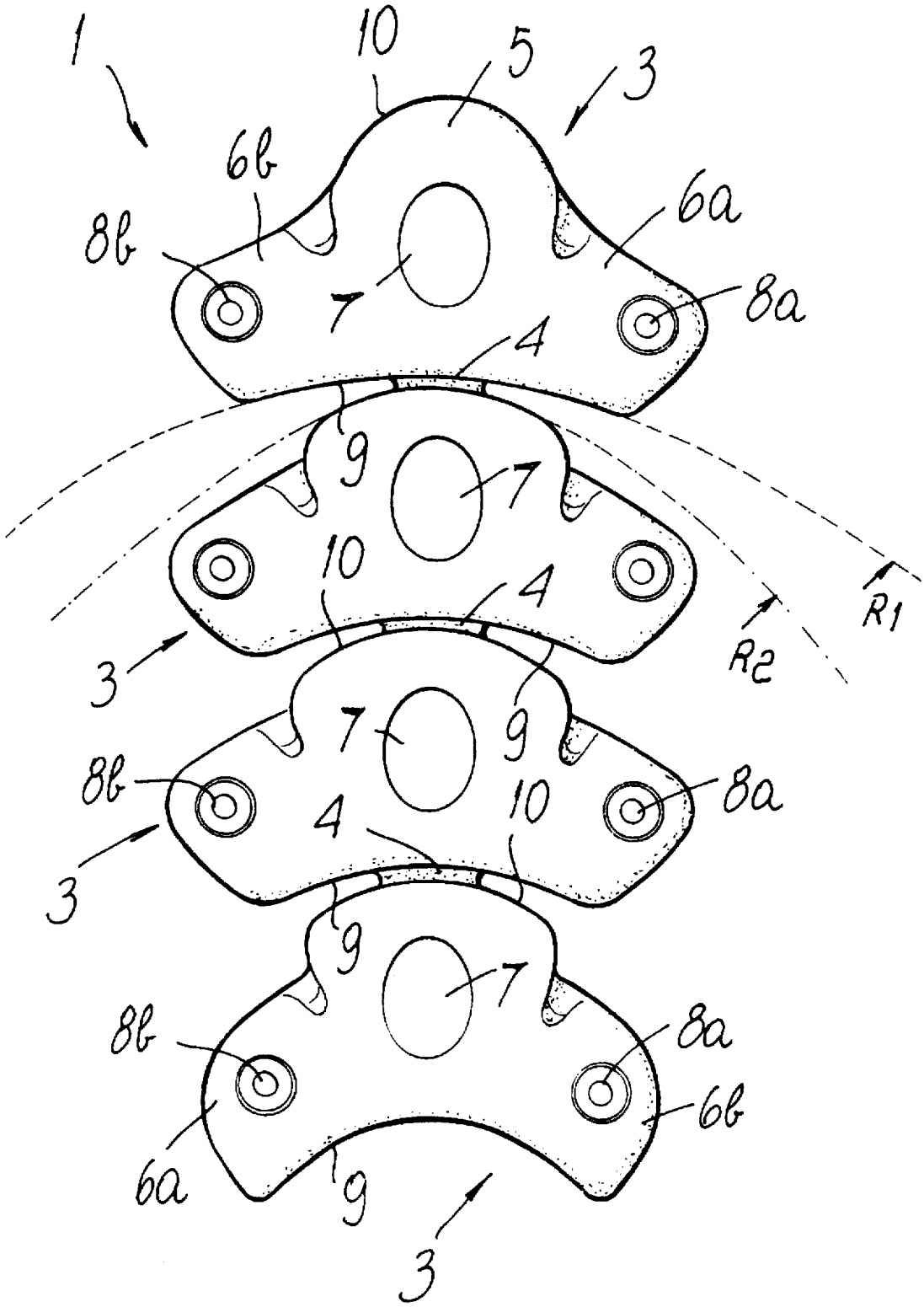
FIG. 1 is a plan view of the device.
Figure 3:
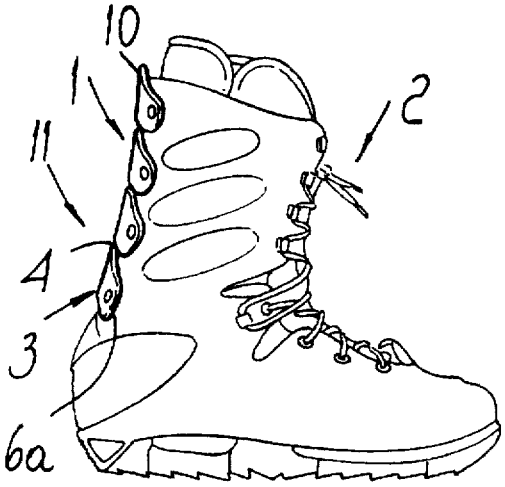
FIG. 3 is a side view of the shoe of FIG. 2.
Figure 2:
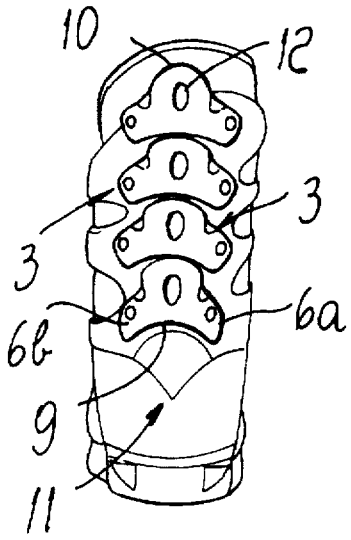
FIG. 2 is a rear view of a sports shoe, such as a climbing boot or a soft shoe for snowboarding, with the device applied thereto.
Figure 6:
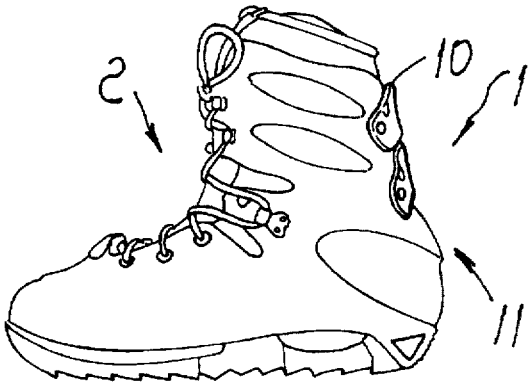
FIG. 6 is a side view of the shoe of FIG. 4.
Figure 4:
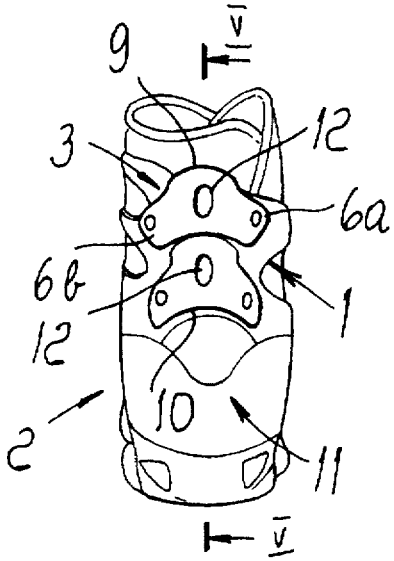
FIG. 4 is a view, similar to FIG. 2, of a shoe with a different form of provision.
Figure 5:
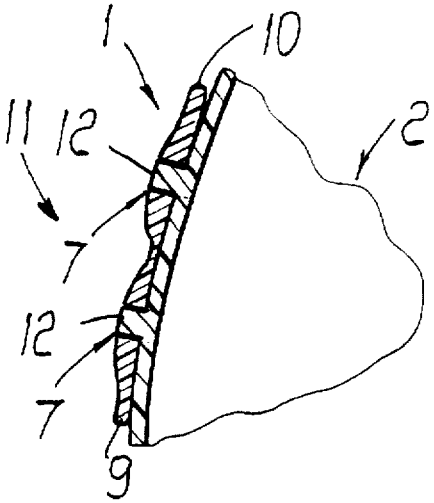
FIG. 5 is a sectional view, taken along the plane V—V of FIG. 4.
Figure 7:
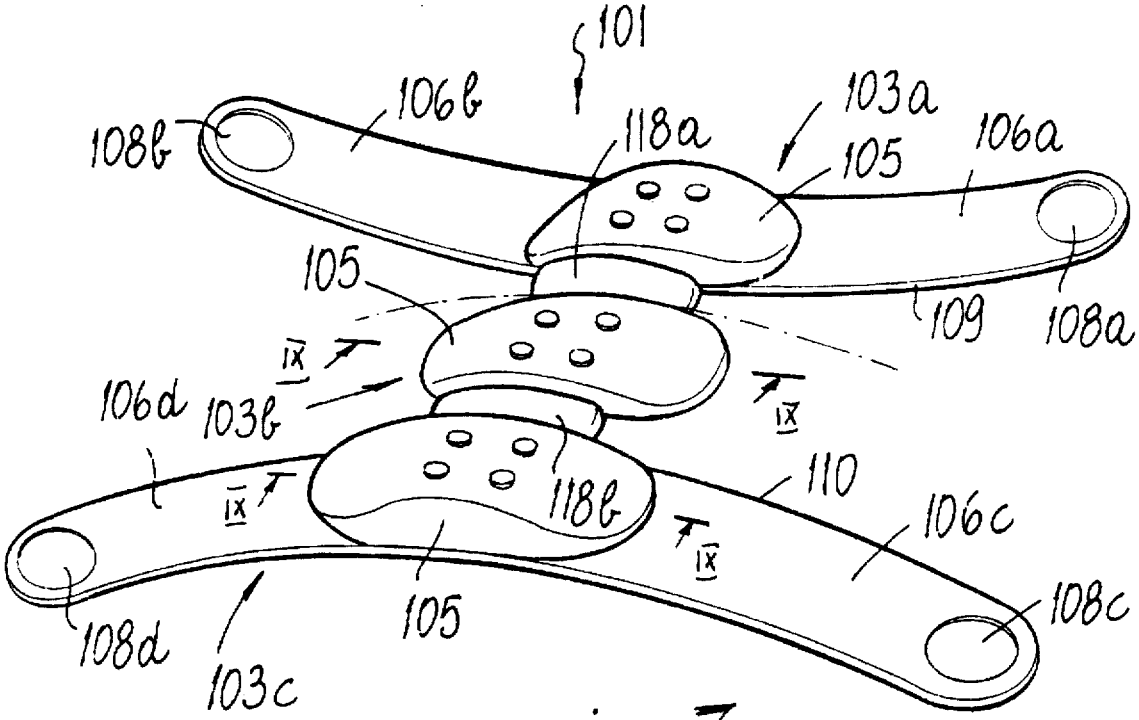
FIG. 7 is a lateral perspective view of a further embodiment of the device.
Figure 8:
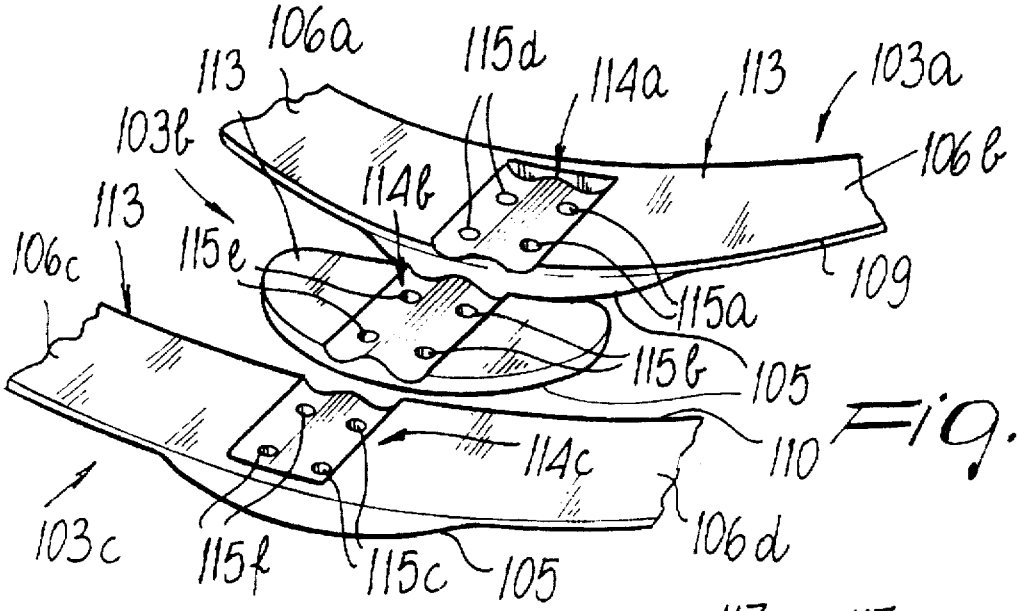
FIG. 8 is an inside view of the device of FIG. 7, in which a component has been omitted for the sake of clarity.
Figure 9:
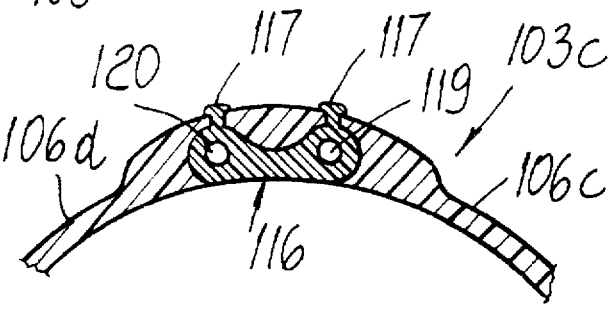
FIG. 9 is a sectional view, taken along the plane IX—IX of FIG. 7.
Figure 13:
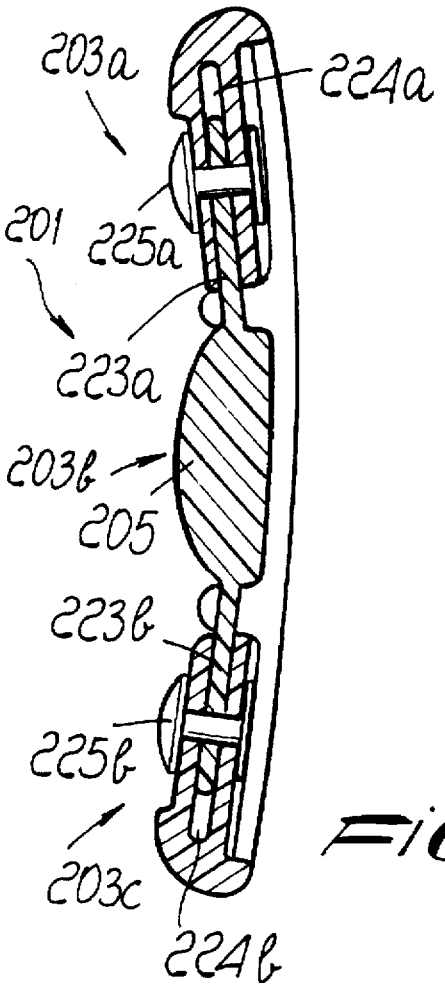
FIG. 13 is a sectional view, taken along the plane XIII—XIII of FIG. 12.
Figure 10:
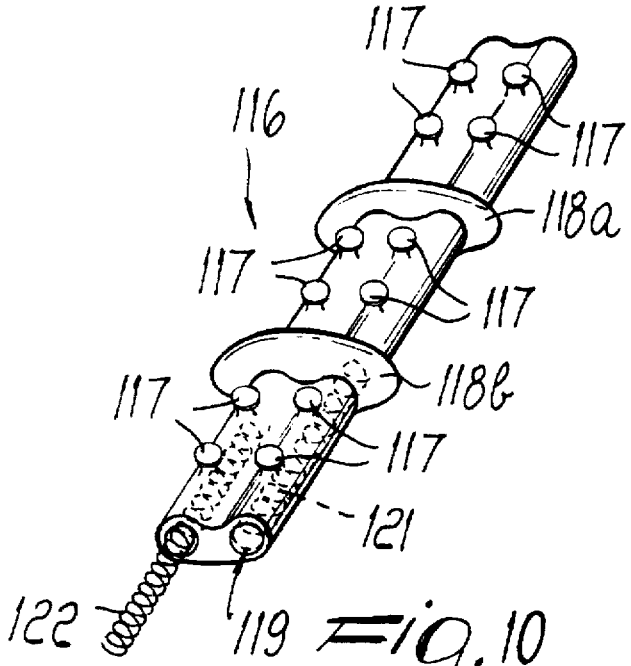
FIG. 10 is a lateral perspective view of the component omitted in FIG. 8.
Figure 11:
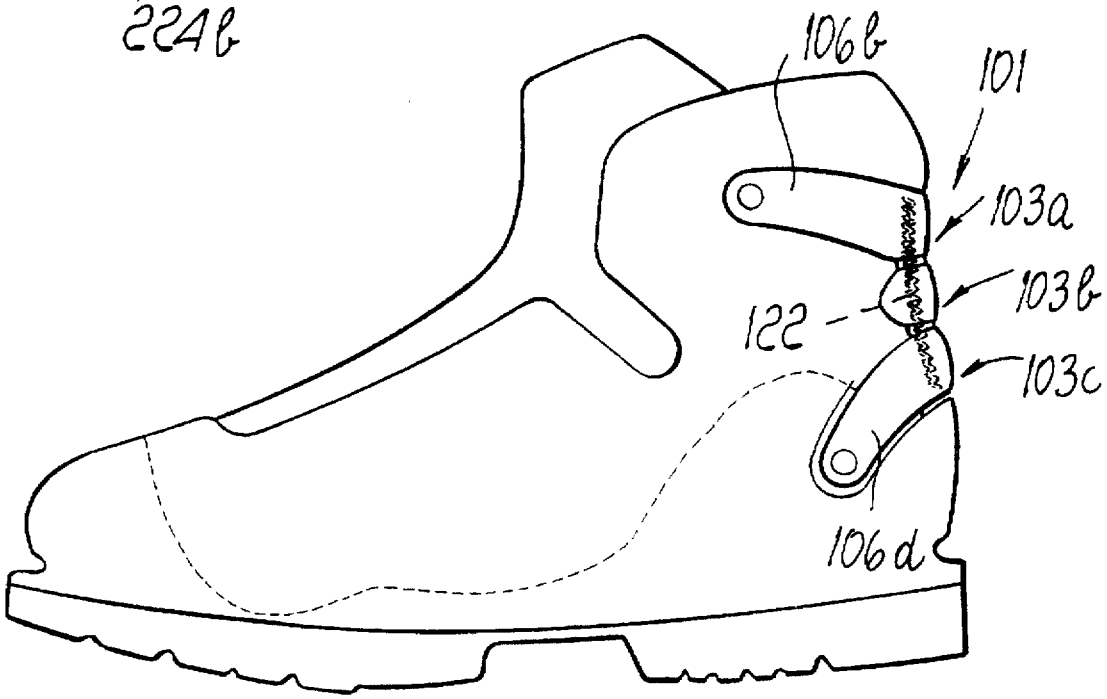
FIG. 11 is a side view of a shoe with the device applied thereto, wherein the presence of a spring has been pointed out for the sake of clarity.

With reference to the above mentioned figures, the reference numeral 1 designates the supporting device, which is particularly usable for sports shoes 2 such as snowboard shoes, trekking boots, athletic shoes, climbing boots, etcetera, that allow full articulation of the ankle.

The supporting device is constituted by two or more elements, designated by the reference numeral 3, that are mutually axially and elastically connected by means of an adapted bridge 4.

Said elements are obtained, for example, by thermoforming plastic material and are substantially arc-shaped.

Each one of said elements thus comprises a body 5, from which two first tabs 6*a* and 6*b* protrude laterally; a recess 7 is advantageously formed in the body 5, and appropriate first holes 8*a* and 8*b*, adapted to allow the coupling of said elements to the shoe 2, are provided proximate to the tips of the first tabs 6*a* and 6*b*.

The bridge 4 thus connects the lower edge 9 of each body 5 to the upper edge 10 of the underlying body 5, preferably at a longitudinal median axis.

The device therefore has a substantially longitudinal arrangement and is preferably associatable at the rear region 11 of the shoe at its longitudinal median axis.

In each one of the elements 3, furthermore, the lower edge 9 and the upper edge 10, in the embodiment illustrated in FIG. 1, are substantially shaped like a circular arc in which the radius $R_1$ of the lower edge 9 is different from the radius of curvature $R_2$ of the upper edge 10.

The difference of these radii of curvature allows each element 3 to rotate with respect to the contiguous one; in this manner, each element can oscillate, for example as a consequence of a lateral flexing, until said oscillation causes mutual abutment between the lower edge of one element and the upper edge of the contiguous one.

The longitudinal connection between the individual elements instead allows to control the longitudinal flexibility of the shoe.

Advantageously, the recess 7 of each element 3 can be arranged at a complementarily shaped raised portion 12 that protrudes to the rear of the upper 2.

It has thus been observed that the invention has achieved the intended aim and objects, a device having been obtained that allows to optimally support the user's ankle and leg and to effectively control the articulation of said ankle in all directions: it is in fact possible to control the lateral articulation of the ankle, since the extent of its oscillation is determined by the sum of the differences of the radii of curvature $R_1$ and $R_2$ of the elements that constitute the supporting device; motion recovery is also facilitated by means of the bridges 4.

A control linked to the axial deformability of said device can be performed for articulation in a longitudinal direction as well.

The supporting device is of course susceptible of numerous modifications and variations, within the scope of the same inventive concept.

Thus, for example, FIGS. 7, 8, 9, 10, and 11 illustrate a supporting device 101 that is constituted by a first upper element 103*a*, by a second central element 103*b*, and by a third lower element 103*c* that are mutually separate.

Said first, second, and third elements are constituted by a body 105 that has a substantially ellipsoidal shape and has a pair of first tabs 106*a*, 106*b*, 106*c*, and 106*d* in the first upper element 103*a* and in the third lower element 103*c*, at the lateral ends.

Said pairs of tabs have, proximate to their tips, adapted first holes 108*a*, 108*b*, 108*c*, and 108*d* for connection to the sports shoe.

Advantageously, the pair of first tabs 106*a* and 106*b* of the first upper element 103*a* has a lower edge 109 whose radius of curvature is equal to, or different from, that of the upper edge 110 of the pair of first tabs 106*c* and 106*d* of the third lower element 103*c* but is centered on the opposite side.

The first upper element 103*a*, the second central element 103*b*, and the third lower element 103*c* have, at the surface 113 that can be arranged adjacent to the sports shoe, a first seat, designated by the reference numerals 114*a*, 114*b*, and 114*c*, that is formed along the same axis that lies longitudinally to the supporting device 101.

Said first seats are therefore mutually aligned and are preferably substantially W-shaped in transverse cross-section; adapted pairs of second holes 115*a*, 115*b*, 115*c*, 115*d*, 115*e*, and 115*f* are formed at said seats along two mutually parallel axes.

Said first seats 114*a*, 114*b*, and 114*c* allow to accommodate therein a complementarily shaped connecting element 116 that has means for connecting to the first upper element, to the second central element, and to the third lower element; said means are constituted by a plurality of mushroom-shaped studs 117 that can be selectively and detachably inserted at the appropriately provided second holes 115*a*, 115*b*, 115*c*, 115*d*, 115*e*, and 115*f* formed on said first, second, and third elements.

Advantageously, said connecting element 116 has adapted annular partitions 118*a* and 118*b* that are adapted to keep the first upper element 103*a*, the second central element 103*b*, and the third lower element 103*c* mutually separated.

A second axial seat 119 and a third axial seat 120 are also formed on the connecting element 116 along two axes that are mutually parallel and approximately match the axes along which the mushroom-shaped studs 117 lie; said seats 119 and 120 are meant to contain adapted flexible elements, such as for example a first spring 121 and a second spring 122.

Since the connecting element 116 is also flexible, this embodiment, too, allows to achieve the intended aim and objects, control of longitudinal and lateral flexing being entrusted predominantly to the connecting element and to the first and second springs.

FIGS. 12, 13, 14, and 15 illustrate another embodiment for a supporting device 201, which is constituted by a first upper element 203*a*, a second central element 103*b*, and a third lower element 203*c* that are mutually separate.

Said first, second, and third elements are constituted by a body 205 that has a substantially ellipsoidal shape and has, in the first upper element 230*a* and in the third lower element 203*c*, at the lateral ends, a pair of first tabs 206*a*, 206*b*, 206*c*, and 206*d*.

Said pairs of tabs have, proximate to their tips, adapted first holes 208*a*, 208*b*, 208*c*, and 208*d* for connection to the sports shoe.

Advantageously, the pair of first tabs 206*a*, 206*b* of the first upper element 203*a* has a lower edge 209 whose radius of curvature is equal to, or different from, that of the upper edge 210 of the pair of first tabs 206*c* and 206*d* of the third lower element 203*c*, but is centered in the opposite direction.

Like the previous solution, the first upper element 203*a*, the second central element 203*b*, and the third lower element 203*c* have a seat, at the surface that can be arranged adjacent to the sports shoe; said seats are mutually aligned and are meant to accommodate a complementarily shaped connecting element 216, which has means for connecting to the first upper element, to the second central element, and to the third lower element; said means are constituted by a plurality of mushroom-shaped studs 217 that can be selectively and detachably inserted at the suitable second holes formed on said first, second and third elements.

A second axial seat and a third axial seat are also formed on the connecting element 216 along two mutually parallel axes that approximately match the axes along which the mushroom-shaped studs 217 are arranged; said seats are meant to contain adapted flexible elements, such as for example a first spring 221 and a second spring 222.

The second central element 203*b* is constituted by a body 205 that has coupling means for complementarily shaped engagement means provided in said first upper element 203*a* and in said third lower element 203*c*; the coupling means are constituted by two second tabs 223*a* and 223*b* that protrude away from the body 205 along a median plane that lies longitudinally with respect to the device and have holes at their tips.

Said tips of said pair of second tabs 223*a* and 223*b* can be arranged outside said first upper element 203*a* and said third lower element 203*c* or at an adapted pair of third seats 224*a* and 224*b* formed inside said elements starting from their respective lower and upper edges 209 and 210.

The engagement means are constituted by adapted lugs that protrude outside said first upper element 203*a* and said third lower element 203*c* at the perforated tips of the second pair of tabs, or by adapted rivets 223*a*, 223*b* that pass at adapted holes provided on said first upper element 203*a* and said third lower element 203*c* and said second pair of tabs, said rivets being adapted to mutually lock said components.

Figure 14:
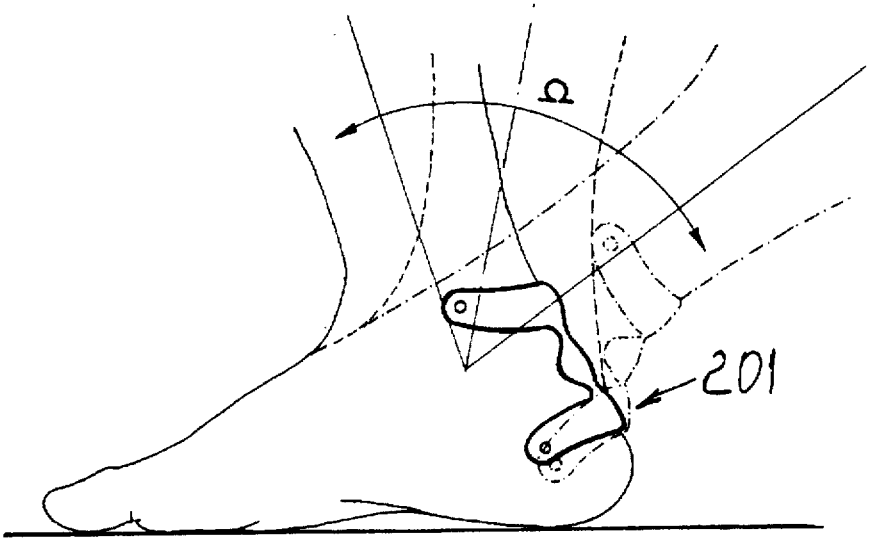
FIG. 14 is a schematic view of the behavior of the device upon longitudinal flexing of the foot.
Figure 12:
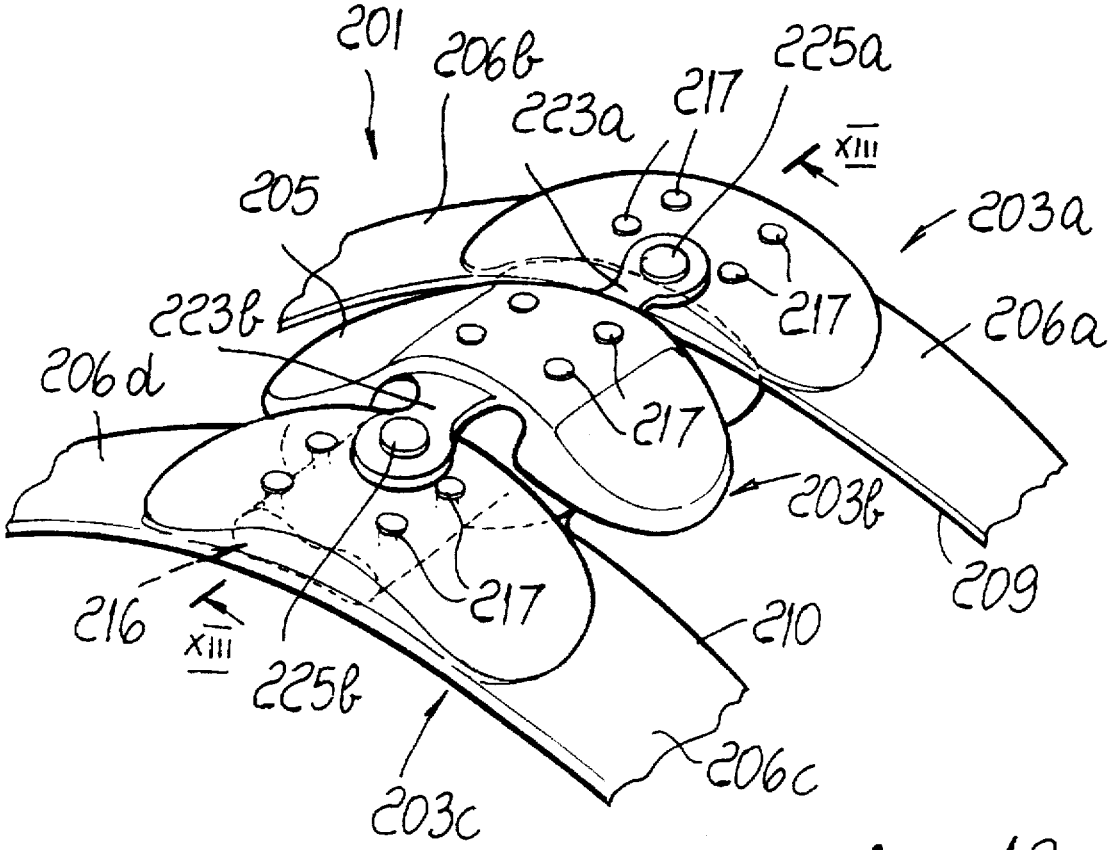
FIG. 12 is a view, similar to FIG. 7, of another embodiment of the device.
Figure 15:
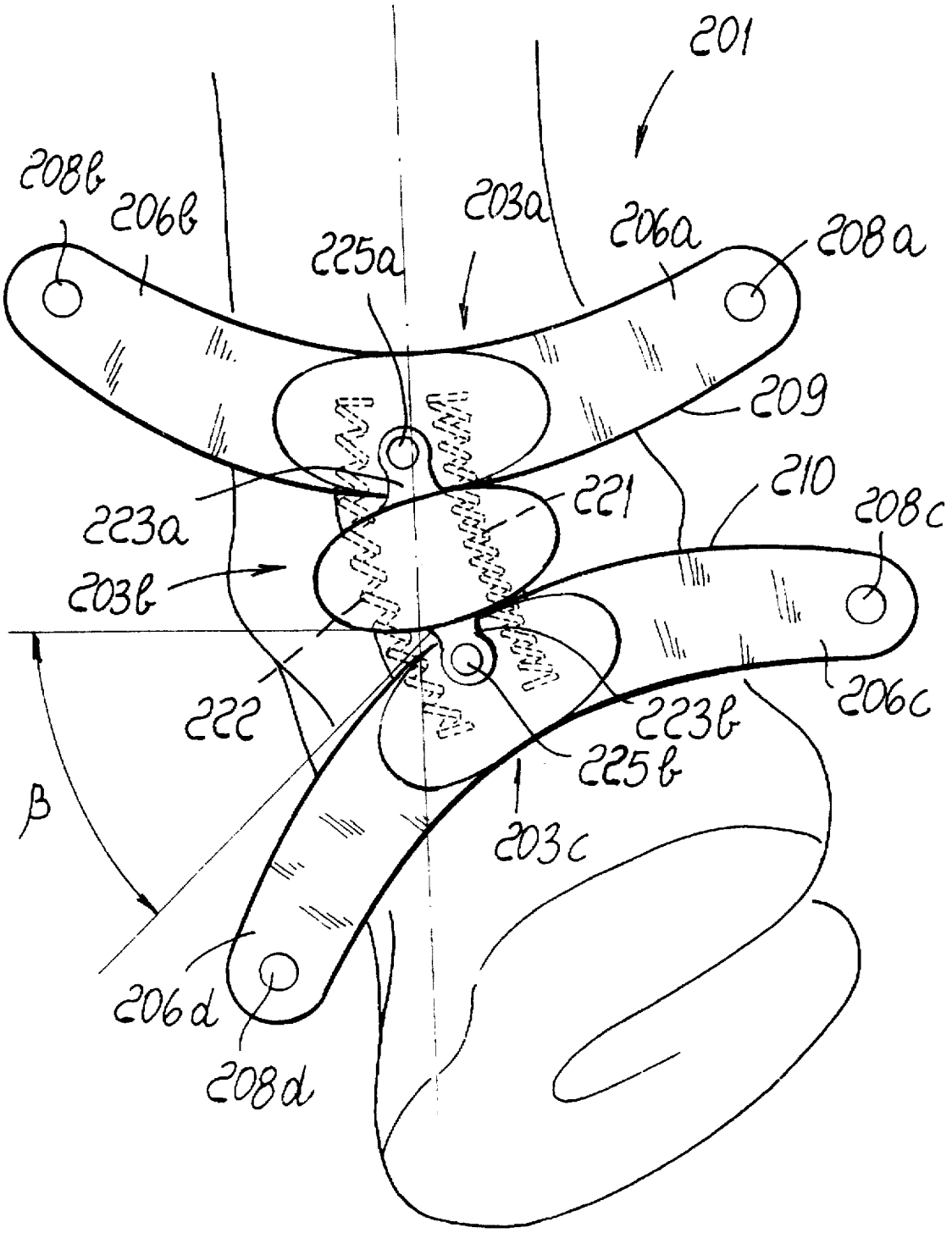
FIG. 15 is a schematic view of the operation of the device upon lateral flexing.

In this case, too, it is possible to control the longitudinal and lateral articulation of the ankle; in the first case, it is possible to hypothesize achieving a stroke that is equal to an acute angle Ω, as shown in FIG. 14, whereas in the second case the device is allowed a variation through an angle β before the body 205 of the second central element 203*b* interacts by abutment against the lower edge 209 of the first upper element 203*a* and the upper edge 210 of the third lower element 203*c*, as shown in FIG. 15.

This solution, too, allows to achieve the intended aim and objects.

The structure of the supporting device described for the embodiments of FIGS. 7–11 and FIGS. 12–15 can of course include a plurality of elements, from a minimum of two, depending on the height of the shoe and on the ankle control and support requirements.

Figure 16:
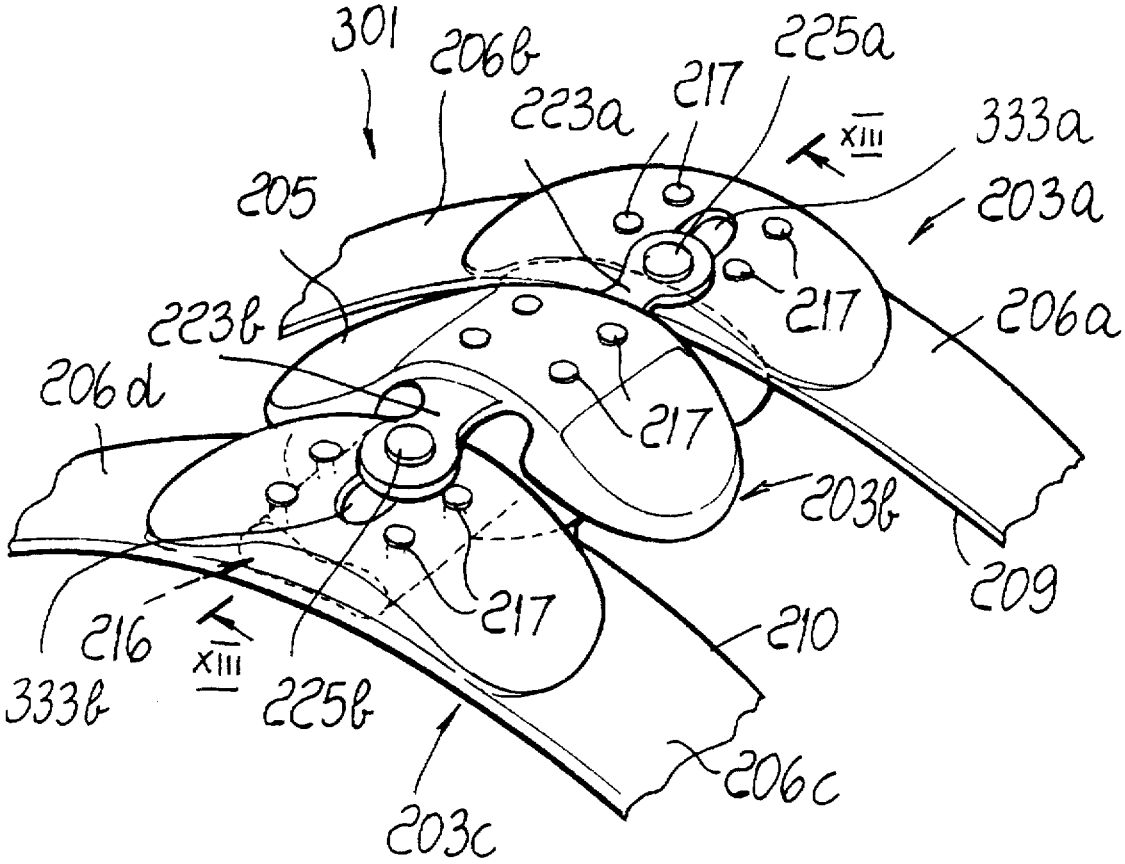
FIG. 16 is a view similar to FIG. 12 of a further embodiment.
Figure 17:
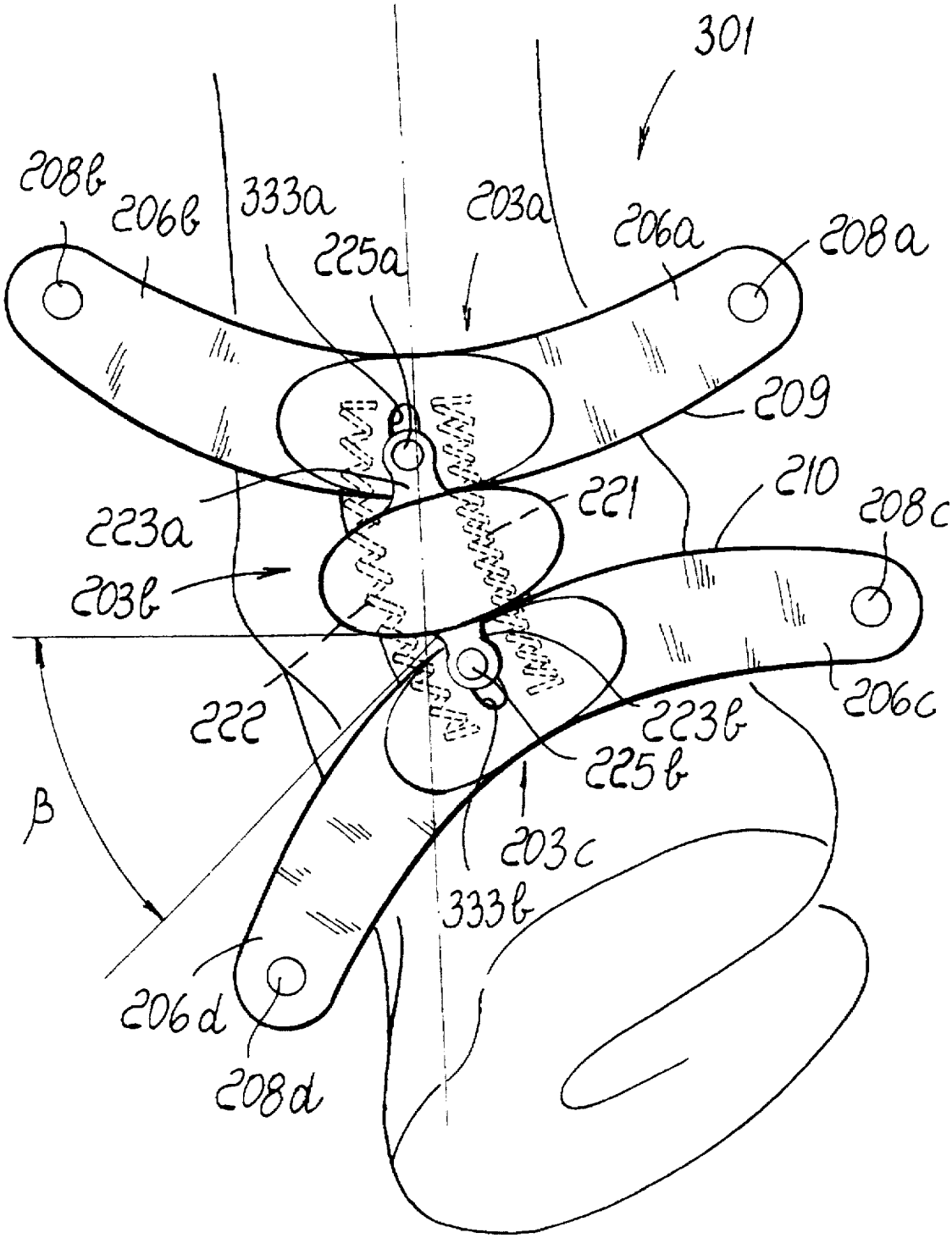
FIG. 17 is a schematic side view showing the operation of the device of FIG. 16.

FIGS. 16–17 illustrate a further embodiment of the device, designated by the reference numeral 301, which is substantially similar to the device 201 described above and wherein the same reference numerals designate similar elements.

The device 301 is substantially similar to device 201, except that the rivets 225*a*, 225*b*, connecting the second tabs 223*a*, 223*b* to the first upper element 203*a* and the third lower element 203*c* respectively, are slideable in adapted slots 333*a*, 333*b* formed in elements 203*a* and 203*c* respectively.

In this manner, elements 203*a* and 203*c* are allowed to slide longitudinally and to rotate.

What is claimed is:

1. A supporting device in combination with a sports shoe, the supporting device comprising a plurality of elements axially and elastically connected to each other and longitudinally associated at a rear region of said shoe, said elements having mutually facing joining regions each having a curved shape and being mutually spaced apart such that a free rotation of one of said elements relative to another of said elements may occur upon a lateral oscillation applied to said shoe until an abutment between said mutually facing regions occurs for blocking said rotation, said elements being mutually axially and elastically connected by means of at least one adapted flexible bridge, and wherein each one of said elements comprises a body from which two first tabs protrude laterally, said tabs having tips and adapted first holes adjacent said tips that allow a coupling of said elements to said shoe.

2. The combination of claim 1, wherein a recess is formed on said body in which is accommodated a complementarily shaped raised portion that protrudes rearwardly of an upper of said shoe.

3. The combination of claim 1, wherein said at least one bridge connects a lower edge of each body to an upper edge of an underlying body along a longitudinal median axis of the shoe.

4. The combination of claim 3, wherein in each one of said elements, said lower edge and said upper edge are substantially shaped like a circular arc with radii of curvature, respectively $R_1$ and $R_2$, that are centered on a same side.

5. The combination of claim 4, wherein said radius $R_1$ of said lower edge is different from said radius $R_2$ of said upper edge, so as to allow each one of said elements to rotate with respect to a contiguous one, so as to allow oscillation, upon lateral flexing, until said oscillation causes a mutual abutment of said lower and upper edges of two contiguous elements.

6. The combination of claim 3, wherein said lower and upper edges are mutually spaced apart.

7. A supporting device in combination with a sports shoe, the supporting device comprising a plurality of rigid elements axially and elastically connected to each other and longitudinally connected to said shoe at a rear region of said shoe, said plurality of elements comprising:

at least one first element having a first central portion and a first pair of wings which extend in mutually opposite directions from said first central portion and which are connected to said shoe; and at least one second element having a second central portion and a second pair of wings which extend in mutually opposite directions from said second central portion and which are connected to said shoe;

said supporting device further comprising:

an elastic longitudinal bridge element interconnected between said first and second elements, said elastic longitudinal bridge element extending at said rear region of said shoe along a longitudinal median axis of said shoe, said elastic longitudinal bridge element being connected to each said central portion of said first and second elements, said elastic longitudinal bridge element being laterally elastically bendable upon a lateral oscillation applied to said shoe, and said elastic longitudinal bridge element being longitudinally elastically bendable upon a forward oscillation and a rearward oscillation applied to said shoe.

8. The combination of claim 7 wherein said first and second elements have mutually facing edges which are mutually spaced from each other in the longitudinal direction of said longitudinal bridge element.

9. The combination of claim 8 wherein said elastic longitudinal bridge element is connected exclusively to said central portions of said first and second elements without being connected to said first and second pairs of wings of said first and second elements.

10. The combination of claim 9 wherein said mutually facing edges of said first and second elements each have a respective curved shape such that said first and second elements may freely rotate with respect to one another when said elastic longitudinal bridge element laterally elastically bends upon a lateral oscillation applied to said shoe until said mutually facing edges make contact with one another.

11. The combination of claim 9 wherein said plurality of elements further comprise a third element which is arranged between said first and second elements, said third element having a lateral dimension which is essentially equal in size to said first and second central portions of said first and second elements.

12. The combination of claim 11 wherein said first and second elements are slidably connected longitudinal direction to said elastic longitudinal bridge element.

* * * * *